US007967696B2

(12) United States Patent
Takeuchi

(10) Patent No.: US 7,967,696 B2
(45) Date of Patent: Jun. 28, 2011

(54) GOLF CLUB

(75) Inventor: Hiroyuki Takeuchi, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

(21) Appl. No.: 12/222,570

(22) Filed: Aug. 12, 2008

(65) Prior Publication Data

US 2009/0069111 A1 Mar. 12, 2009

(30) Foreign Application Priority Data

Sep. 10, 2007 (JP) ..... 2007-233922

(51) Int. Cl.
*A63B 53/12* (2006.01)
*A63B 53/10* (2006.01)

(52) U.S. Cl. ..... 473/318

(58) Field of Classification Search ..... 473/256, 473/297, 318
See application file for complete search history.

(56) References Cited

U.S. PATENT DOCUMENTS 2,608,409 A * 8/1952 Pinkerton ..... 473/256
4,602,504 A * 7/1986 Barber ..... 73/49.8
5,277,423 A * 1/1994 Artus ..... 473/319
5,294,119 A * 3/1994 Vincent et al. ..... 473/318
5,419,031 A * 5/1995 McLendon ..... 29/450
5,524,885 A * 6/1996 Heo ..... 473/299
5,569,097 A * 10/1996 Veux et al. ..... 473/292
6,083,116 A * 7/2000 Loredo ..... 473/256
6,955,609 B1 * 10/2005 Hiltner et al. ..... 473/176
2002/0115499 A1 * 8/2002 Todd ..... 473/318
2005/0227786 A1 * 10/2005 Sullivan et al. ..... 473/371
2008/0113826 A1 * 5/2008 Lin ..... 473/302

FOREIGN PATENT DOCUMENTS

JP 2000-5361 A 1/2000
JP 2005-169026 A 6/2005

* cited by examiner

*Primary Examiner* — Stephen L. Blau
(74) *Attorney, Agent, or Firm* — Birch, Stewart, Kolasch & Birch, LLP

(57) ABSTRACT

A golf club (2) includes a head (4), a shaft (6) and a grip (8). An elastic member (10) is attached to an external surface of the shaft (6). The elastic member (10) is ring-shaped and has no end. The elastic member (10) is externally fitted in the shaft (6) in a state in which an elastic contracting force is maintained. It is preferable that a fastening member for fastening the elastic member (10) from an outside should be provided. The fastening member is constituted to enable a mutual transition of a fastening state in which the elastic member is fastened and a removing state in which the fastening member is removed from the elastic member and is also removed from the golf club. It is preferable that the fastening member should be provided in no contact with the shaft (6) in the fastening state.

5 Claims, 11 Drawing Sheets

GOLF CLUB

This application claims priority on patent application Ser. No. 2007-233922 filed in JAPAN on Sep. 10, 2007, the entire contents of which are hereby incorporated by reference.

BACKGROUND OF THE INVENTION

1. Field of the Invention

The present invention relates to a golf club.

2. Description of the Related Art

There has been proposed a technique for attaching a weight onto an external surface of a shaft or a hosel of a golf club. Japanese Laid-Open Patent Publication No. 2005-169026 has disclosed a golf club in which a weight divided into two pieces is attached to a shaft with two fixing bolts. Japanese Laid-Open Patent Publication No. 2000-5361 has disclosed a weight of an elastic member having an attaching and removing notch. FIG. 4 and the like in the Japanese Laid-Open Patent Publication No. 2000-5361 have shown fastening means for coupling an outer periphery of the attaching and removing notch with a compression tape. FIG. 8 and the like in the Japanese Laid-Open Patent Publication No. 2000-5361 have disclosed fastening means using hook fittings or the like.

SUMMARY OF THE INVENTION

In the technique disclosed in the Japanese Laid-Open Patent Publication No. 2005-169026, in the case in which a soft member is used for a weight, the weight formed by the soft material is apt to be deformed by a fastening force of the fixing bolts. Due to the deformation of the weight, a bonding surface of the weights to be the two pieces and a contact surface with the shaft are deformed so that an insufficiency of a fixation to the shaft or a damage of the weight is apt to be caused. On the other hand, in the technique disclosed in the Japanese Laid-Open Patent Publication No. 2005-169026, in the case in which the hard member is used for the weight, the external surface of the shaft in a portion provided in contact with the weight is apt to be damaged by the fastening force of a fastening bolt. In the case in which the fastening force of the bolt is reduced in order to suppress the damage, the fixation to the shaft is made insufficient. In the case in which the hard member is used for the weight, a contact area of the external surface of the shaft with the weight is reduced easily so that the fixation to the shaft is apt to be insufficient.

In the technique disclosed in the Japanese Laid-Open Patent Publication No. 2000-5361, in the case in which the soft member is used for the weight, an outside of the weight is fastened by the fastening means so that the weight itself is expanded and deformed. For this reason, the weight is apt to be insufficiently fastened to the shaft. On the other hand, in the technique disclosed in the Japanese Laid-Open Patent Publication No. 2000-5361, in the case in which the hard member is used for the weight, a stress generated with the deformation in an attachment and removal locally concentrates easily. By the concentration of the stress, a durability to a repetitive attachment and removal is apt to be insufficient.

It is an object of the present invention to provide a golf club which has a removable elastic member from an external surface of a shaft and can enhance a fixing property and a durability of the elastic member.

A golf club according to the present invention comprises a head, a shaft and a grip. An elastic member is attached to an external surface of the shaft. The elastic member is ring-shaped and has no end. The elastic member is externally fitted in the shaft in a state in which an elastic contracting force is maintained.

It is preferable that the golf club should further comprise a fastening member for fastening the elastic member from an outside. The fastening member is constituted to enable a mutual transition of a fastening state in which the elastic member is fastened and a removing state in which the fastening member is removed from the elastic member and is also removed from the golf club. The fastening member is provided in no contact with the shaft in the fastening state.

It is preferable that the fastening member should be ring-shaped in the fastening state. It is preferable that a circumference of the fastening member can be regulated.

It is preferable that concavo-convex portions should be provided on an internal surface of the elastic member.

Another golf club according to the present invention comprises a head, a shaft, a grip, an elastic member and a fastening member. The elastic member is attached to an external surface of the shaft. The fastening member fastens the elastic member from an outside. The fastening member is constituted to enable a mutual transition of a fastening state in which the elastic member is fastened and a removing state in which the fastening member is removed from the elastic member and is also removed from the golf club. The fastening member is provided in no contact with the shaft in the fastening state. A complex elastic modulus of the elastic member is equal to or higher than $1.4\times10^{7}$ (dyn/cm$^2$) and is equal to or lower than $2.0\times10^{10}$ (dyn/cm$^2$).

DESCRIPTION OF THE PREFERRED EMBODIMENTS

The present invention will be described below in detail based on a preferred embodiment with reference to the drawings. In the following description, an "axial direction" implies an axial direction of a shaft except for the case described particularly. In the following description, a "radial direction" implies a radial direction of the shaft except for the case described particularly.

Figure 1:
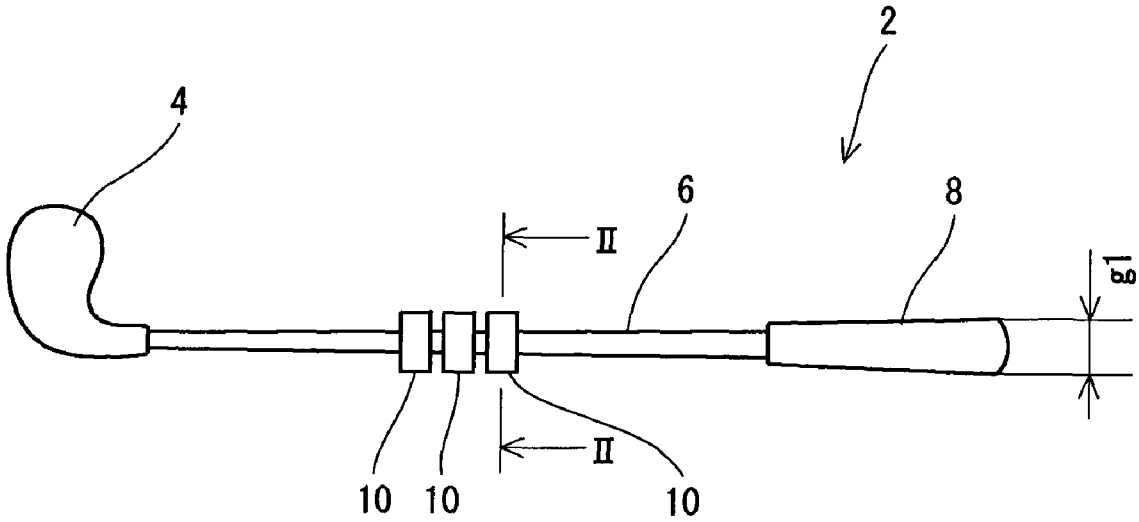
FIG. 1 is a general view showing a golf club according to an embodiment of the present invention.

As shown in FIG. 1, a golf club 2 has a head 4, a shaft 6 and a grip 8. The grip 8 is attached to one of ends of the shaft 6. The head 4 is attached to the other end of the shaft 6.

An elastic member 10 is attached to the shaft 6. The elastic member 10 is attached to an external surface of the shaft 6. In an embodiment of FIG. 1, three elastic members 10 are attached. The number of the elastic members 10 is not restricted.

Figure 2:
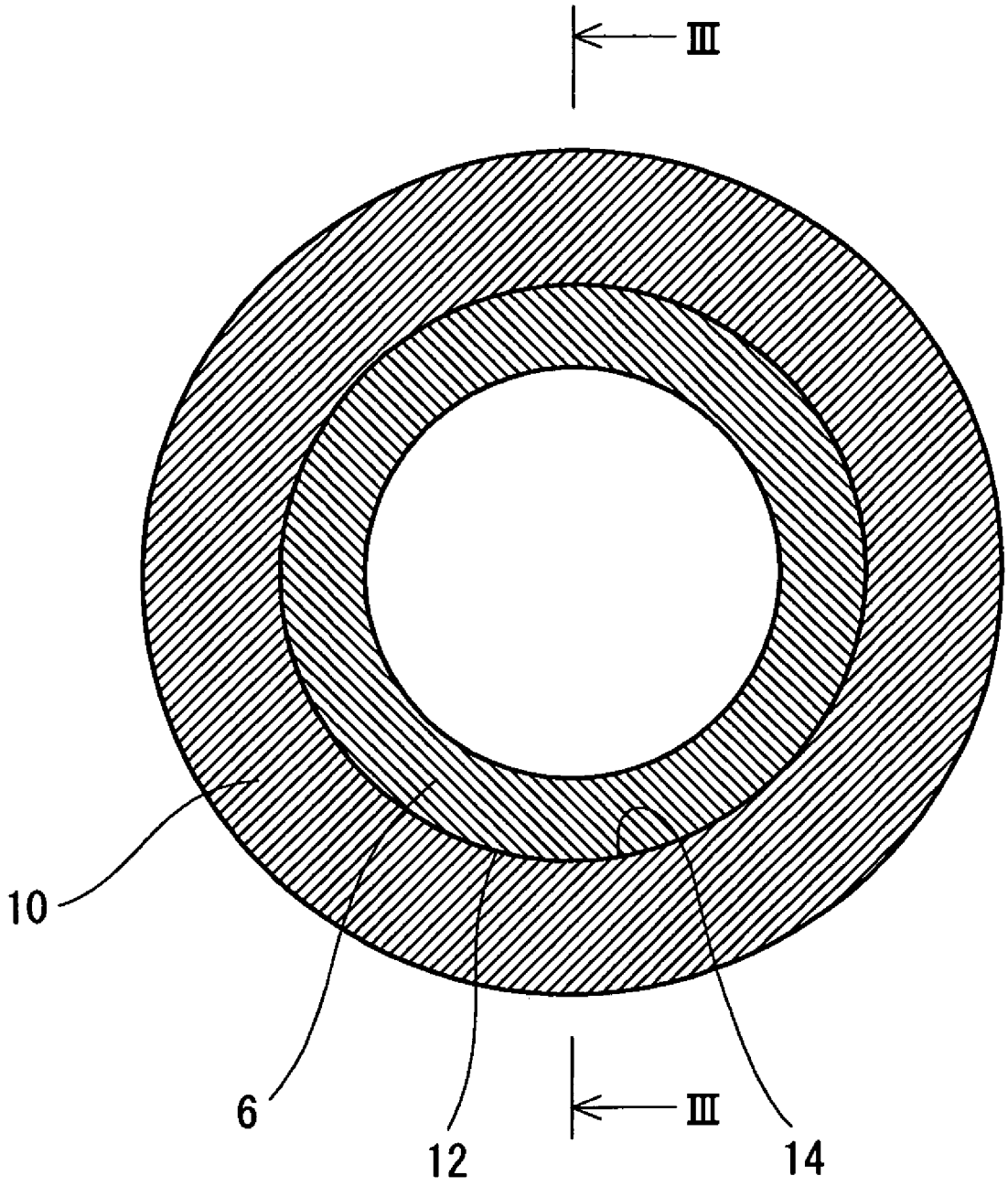
FIG. 2 is a sectional view taken along a II-II line of FIG. 1.
Figure 3:
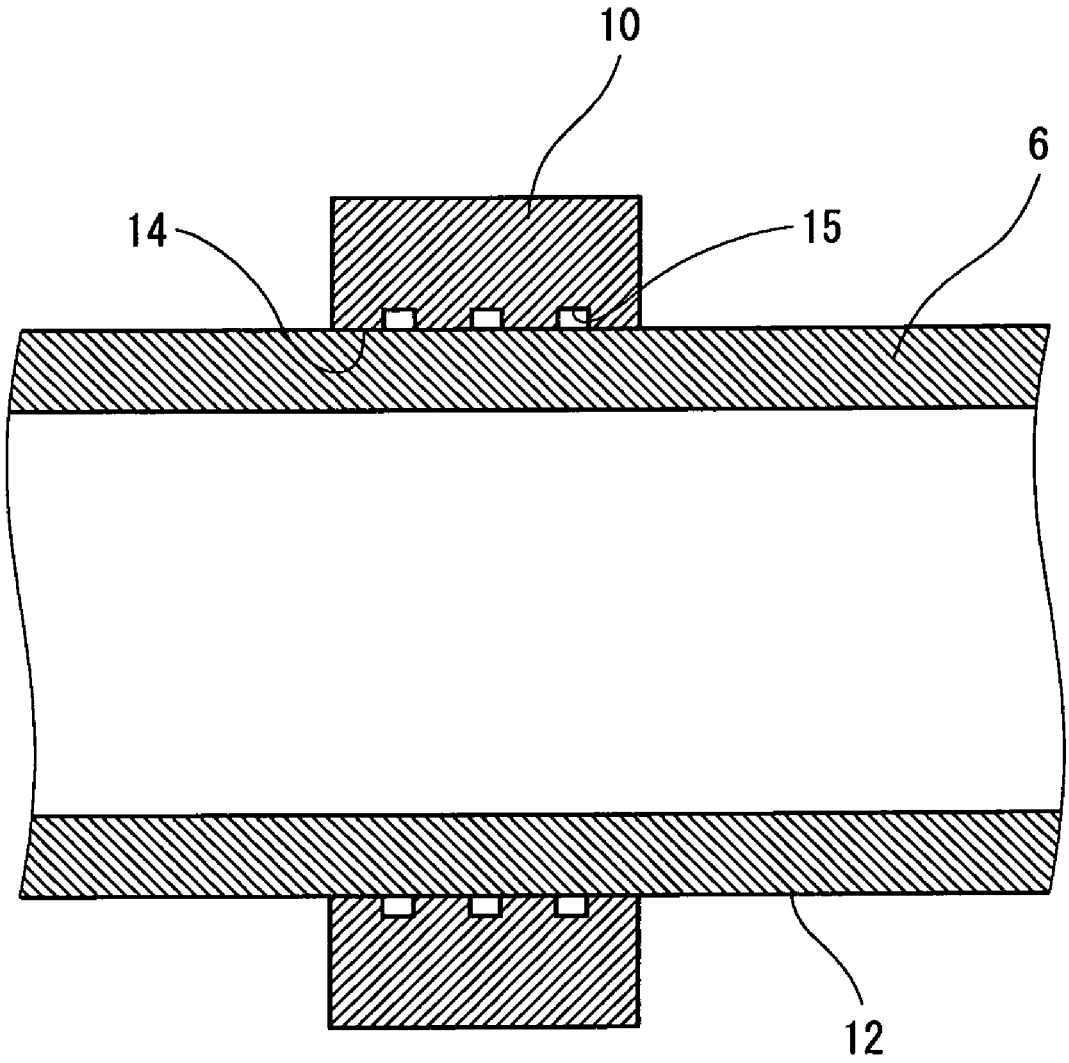
FIG. 3 is a sectional view taken along a III-III line of FIG. 2.

FIG. 2 is a sectional view taken along a II-II line of FIG. 1. FIG. 3 is a sectional view taken along a III-III line of FIG. 2. The shaft 6 takes a tubular shape. The shaft 6 is hollow. An inner part of the shaft 6 is a space. For the shaft 6, a steel shaft or carbon shaft is illustrated.

An external surface 12 of the shaft 6 is tapered. An outside diameter of the shaft 6 is reduced closer to the head 4. The outside diameter of the shaft 6 is increased closer to the grip 8.

The elastic member 10 is attached to the external surface 12 of the shaft 6. The elastic member 10 is ring-shaped. The elastic member 10 has no end. The elastic member 10 is wholly integral in a circumferential direction. The elastic member 10 takes a cylindrical shape. An inner peripheral surface 14 of the elastic member 10 comes in contact with the external surface 12 of the shaft 6. The inner peripheral surface 14 of the elastic member 10 is provided in face contact with the external surface 12 of the shaft 6.

As shown in FIG. 3, a groove 15 is provided on the inner peripheral surface 14 of the elastic member 10. In the embodiment shown in FIG. 3, three grooves 15 are provided. The groove 15 is extended in the circumferential direction of the elastic member 10. Concavo-convex portions are formed by the groove 15 and portions other than the groove 15 over the internal surface of the elastic member 10. During a swing, a centrifugal force acts on the elastic member 10. The centrifugal force acts in a direction set almost along a longitudinal direction of the shaft 6. The groove 15 is extended in an almost orthogonal direction to the centrifugal force. Accordingly, the groove 15 extended in the circumferential direction can effectively suppress a slip of the elastic member 10 caused by the centrifugal force.

In place of the groove 15, a rib may be provided. In this case, the concavo-convex portions are formed by the rib and portions other than the rib. By forming a projection and/or a recess, it is also possible to form the concavo-convex portions. By the concavo-convex portions formed on the internal surface of the elastic member 10, the elastic member 10 can easily be fixed to the shaft 6.

In respect of a reliable fixation of the elastic member 10, a concavo-convex height hi on the internal surface of the elastic member 10 is preferably equal to or greater than 0.1 mm, is more preferably equal to or greater than 0.3 mm and is further preferably equal to or greater than 0.5 mm. In some cases in which the concavo-convex height is excessively great, the convex portion falls down so that there is a possibility that the fixation of the elastic member 10 might be uncertain. From this viewpoint, the concavo-convex height h1 is preferably equal to or smaller than 3 mm, is more preferably equal to or smaller than 2 mm, and is further preferably equal to or smaller than 1 mm. In the embodiment, the concavo-convex height h1 corresponds to a depth of the groove 15.

The elastic member 10 can expand and contract. The elastic member 10 is externally fitted in the shaft in a state in which an elastic contracting force is maintained. An inside diameter of the elastic member 10 in a state in which an external force does not act on the elastic member 10 is smaller than a maximum outside diameter of the shaft 6. An inside diameter of the elastic member 10 in the state in which the external force does not act on the elastic member 10 is smaller than an outside diameter of the shaft 6 in an attaching position of the elastic member 10. It is preferable that the inside diameter of the elastic member 10 in the state in which the external force does not act on the elastic member 10 is smaller than a minimum outside diameter of the shaft 6. Irrespective of a position of the elastic member 10 in a longitudinal direction of the shaft 6, consequently, the elastic member 10 can be attached to the shaft 6 in the state in which the elastic contracting force is maintained.

In FIG. 1, a double arrow g1 indicates a maximum outside diameter of the grip 8. The maximum outside diameter g1 is greater than a maximum outside diameter of the shaft 6. The elastic member 10 can be elastically deformed in such a manner that an inside diameter thereof is greater than the maximum outside diameter g1.

The elastic member 10 can be freely attached to and removed from the golf club comprising the head 4, the shaft 6 and the grip 8. In other words, the elastic member 10 can be freely attached to and removed from the assembled golf club.

The elastic member 10 can function as a weight for regulating a center of gravity, a swing balance and the like of the golf club 2. Moreover, the elastic member 10 can function as a member for regulating a rigidity of the shaft 6. Furthermore, the elastic member 10 can function as a vibration absorbing member for absorbing a vibration generated by a shock in hitting. In order to enhance the function of the weight, it is preferable to blend metal powder having a great specific gravity into a material of the elastic member 10. The specific gravity of the metal powder is preferably equal to or greater than 10 and is further preferably equal to or greater than 15. For the metal powder, tungsten alloy powder is illustrated.

The elastic member 10 is ring-shaped and has no end. Therefore, a stress concentration in a specific portion or an intensive deformation of the specific portion is generated with difficulty. Accordingly, the elastic member 10 is excellent in a durability. Since the elastic member 10 has an elasticity, the shaft 6 is damaged with difficulty due to a contact with the shaft 6. Since the elastic member 10 can elastically expand and contract, it can be extended in such a manner that an inside diameter thereof is increased. Accordingly, the elastic member 10 can be attached to the shaft 6 through an insertion of the grip 8 of the golf club.

An example of a method of attaching the elastic member 10 will be described below. The elastic member 10 is attached from the grip 8 side of the golf club 2. The grip 8 of the golf club 2 is inserted through the elastic member 10 while the elastic member 10 is extended to increase a diameter thereof. Next, the elastic member 10 is moved to a desirable position on the shaft 6 in the extending state. Finally, the extension of the elastic member 10 is released. By the release, the elastic member 10 elastically contracts, and at the same time, the elastic member 10 is disposed in the desirable position on the shaft 6 in a state in which an elastic contracting force is maintained.

An example of the method of removing the elastic member 10 will be described below. The method of removing the elastic member 10 can be carried out in a reverse procedure to the method of attaching the elastic member 10. First of all, the elastic member 10 is extended to increase the diameter. Next, the golf club 2 is pulled out with the elastic member 10 extended. The elastic member 10 is removed from the grip 8 side.

Figure 4:
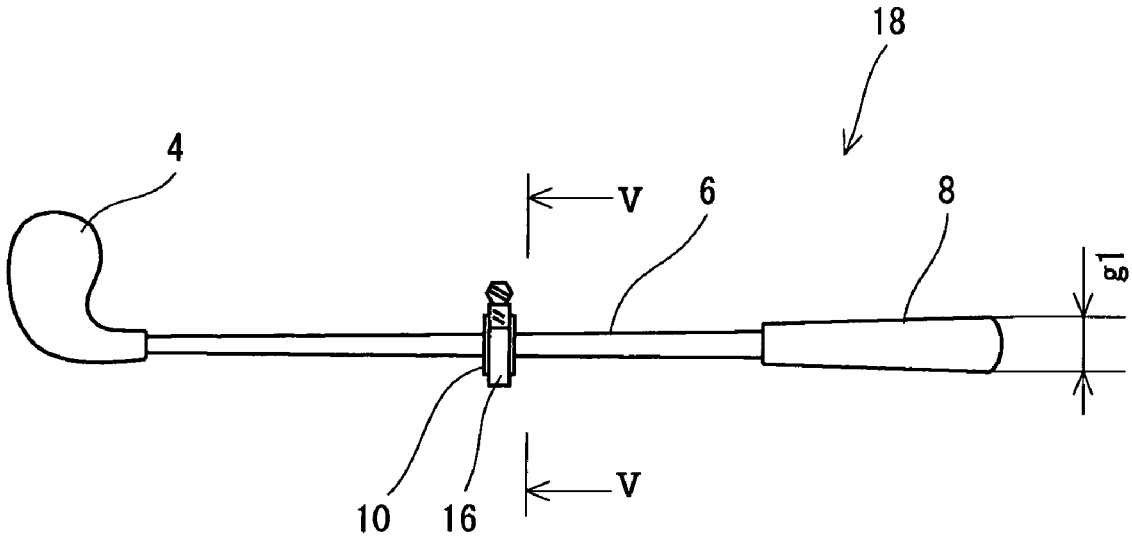
FIG. 4 is a general view showing a golf club according to another embodiment.
Figure 5:
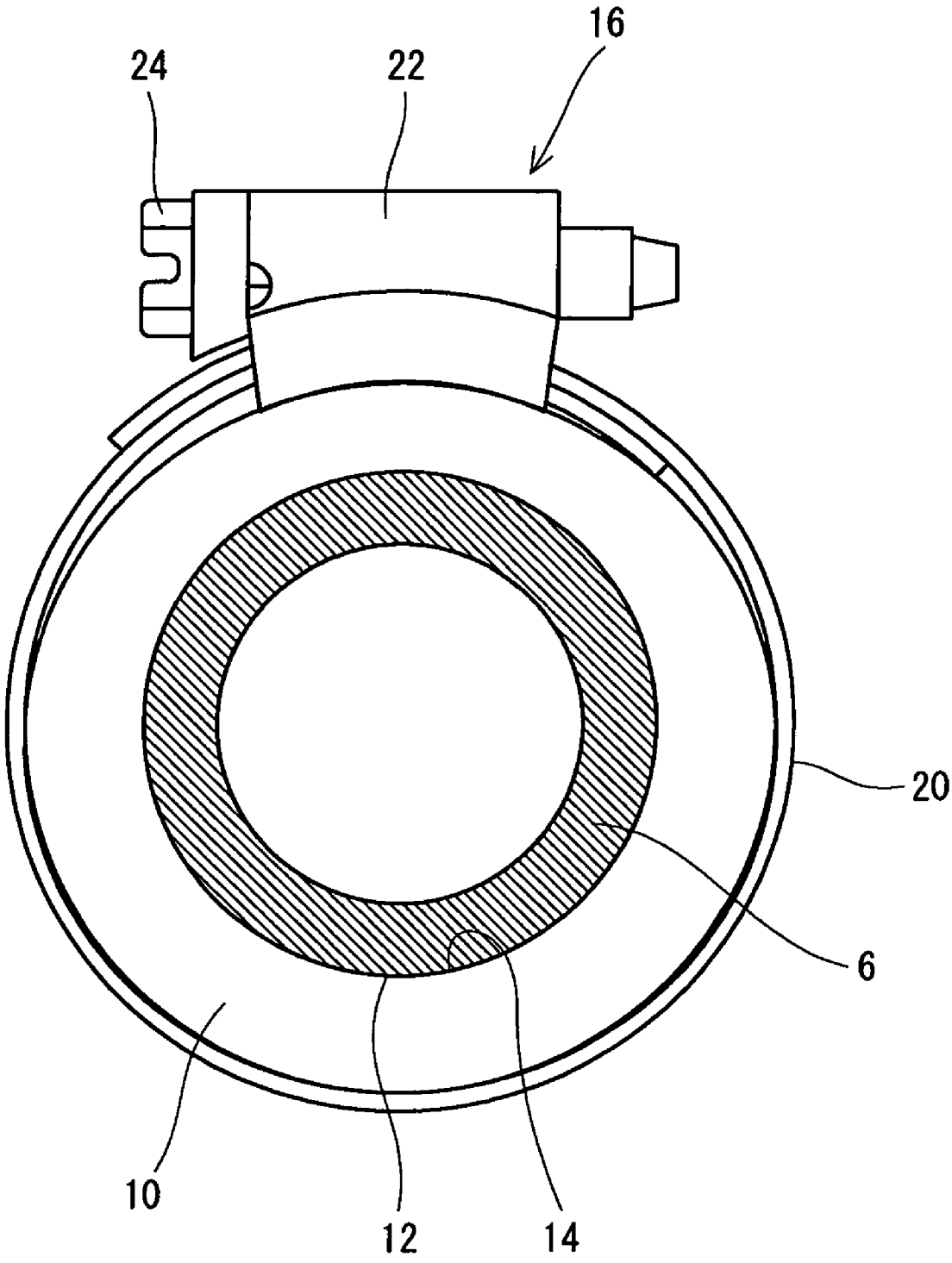
FIG. 5 is a sectional view taken along a V-V line of FIG. 4.
Figure 6:
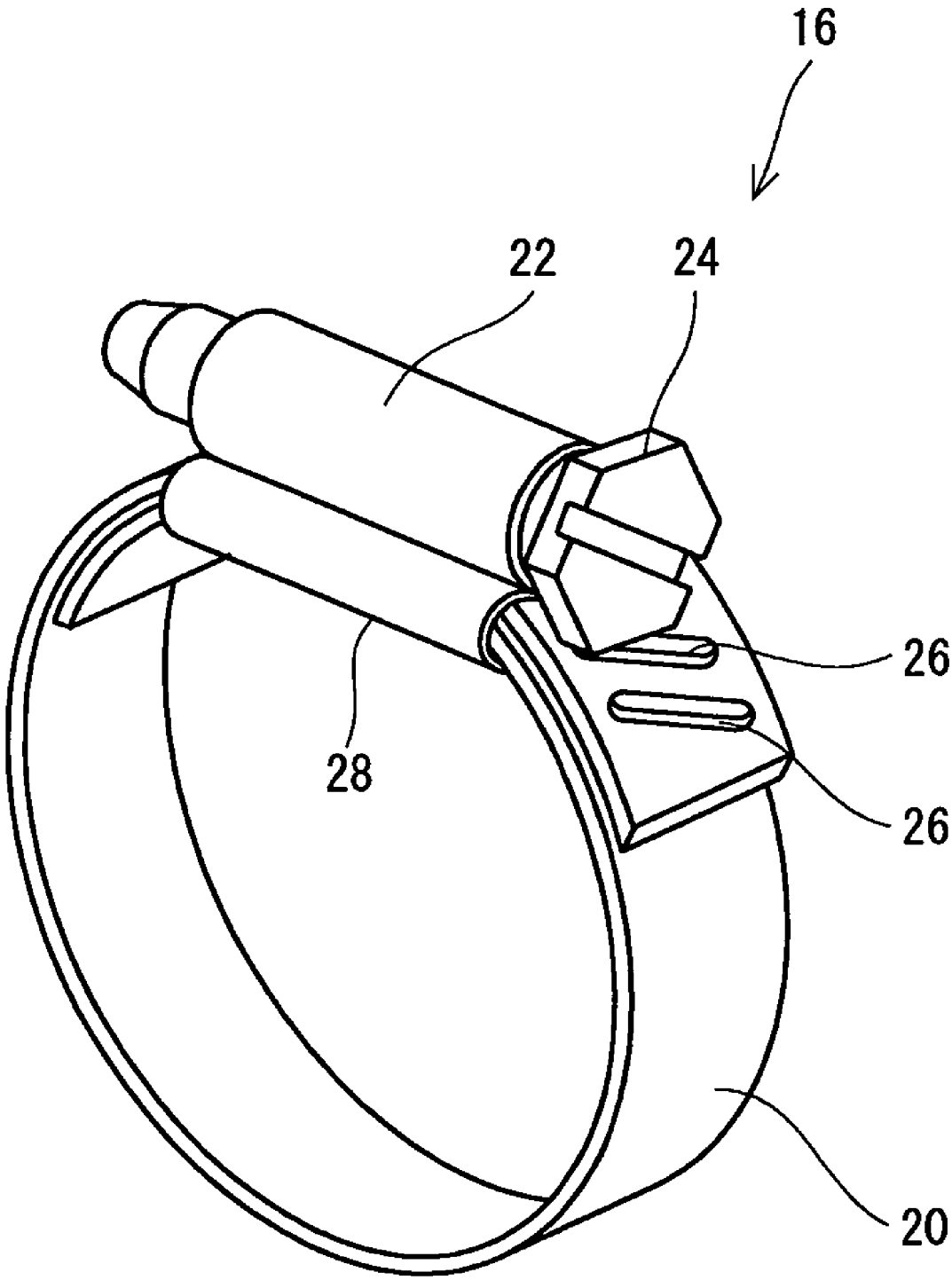
FIG. 6 is a perspective view showing a fastening member.
Figure 7:
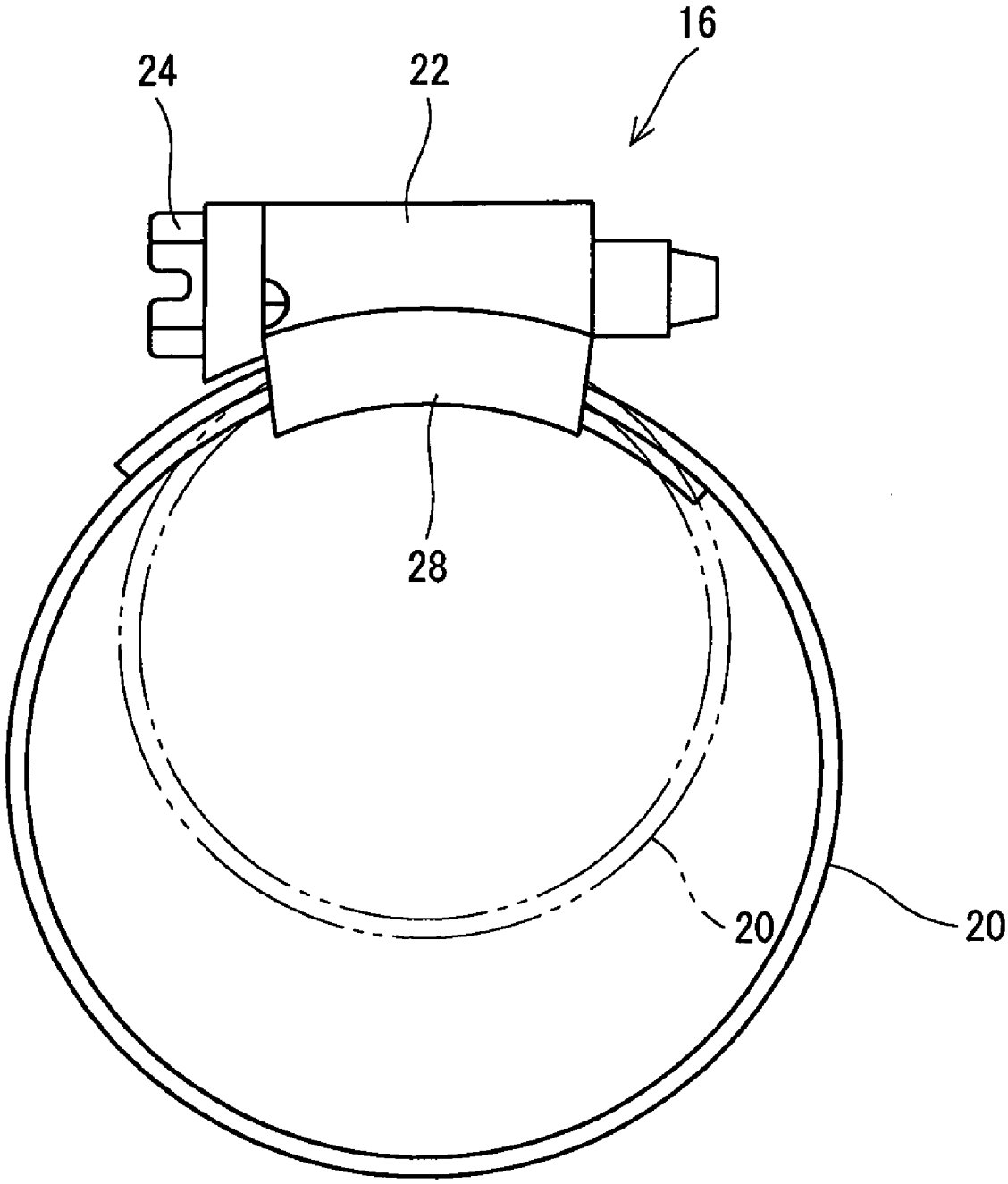
FIG. 7 is a side view showing the fastening member of FIG. 6.

It is preferable that the golf club 2 should comprise a fastening member 16 for fastening the elastic member 10 from an outside. FIG. 4 is a general view showing a golf club 18 in which the fastening member 16 is attached to the outside of the elastic member 10, and FIG. 5 is a sectional view taken along a V-V line of FIG. 4. In the golf club 18, a single elastic member 10 is provided. FIG. 6 is a perspective view showing the fastening member 16 and FIG. 7 is a side view showing the fastening member 16.

As shown in FIG. 5, the fastening member 16 is provided over a whole outer peripheral surface of the elastic member 10. The fastening member 16 is externally fitted in the elastic member 10. The fastening member 16 fastens the elastic member 10 from an outside. The fastening member 16 is ring-shaped in the fastening state.

The fastening member 16 has a circumference regulating mechanism capable of regulating a circumference thereof. In the fastening member 16 according to the present embodiment, a worm mechanism is used as the circumference regulating mechanism. Every mechanism used in a so-called hose band can be employed as the circumference regulating mechanism.

The fastening member 16 has a band 20, a housing 22 and a screw 24. The band 20 is rounded almost along a circle. Both ends of the band 20 are caused to overlap each other. The housing 22 supports the screw 24 in an axially rotatable state.

As shown in FIG. 6, a concave portion 26 is provided in a part disposed on an outside in the radial direction in both ends of the band 20 which are caused to overlap each other. A plurality of concave portions 26 is provided at a regular interval. The concave portion 26 is extended in an inclined direction to a longitudinal direction of the band 20. On the other hand, a part disposed on an inside in the radial direction in the both ends of the band 20 which are caused to overlap each other is fixed to an inside portion 28 of the housing 22.

A spiral thread is provided on the screw 24, which is not shown. The thread is engaged with the concave portion 26. An extending direction and an installing interval of the concave portion 26 correspond to an extending direction and a pitch of the thread of the screw 24. An installing range of the concave portion 26 corresponds to a range in which a circumference can be regulated.

When the screw 24 is axially rotated, the end of the band 20 which is engaged with the screw 24 is fed out. Depending on a rotating direction and a rotating amount of the screw 24, the circumference of the band 20 can be regulated. A two-dotted chain line in FIG. 7 indicates the band 20 in a state in which the circumference is shortened. Thus, the worm mechanism is constituted by the engagement of the concave portion 26 of the band 20 with the screw 24.

When the circumference of the band 20 is more reduced, the elastic member 10 is fastened more strongly. When the elastic member 10 is fastened excessively strongly, a vibration absorbing performance is apt to be reduced. When the elastic member 10 is fastened loosely, the elastic member 10 is fixed with difficulty. In consideration of a fixing degree of the elastic member 10 and the vibration absorbing performance, it is possible to determine a fastening degree to the elastic member 10.

The fastening member 16 can be freely attached to and removed from the golf club comprising the head 4, the shaft 6, the grip 8 and the elastic member 10. In other words, the fastening member 16 can be freely attached to and removed from the golf club which is assembled and has the elastic member 10 attached thereto.

An example of the method of attaching the fastening member 16 will be described below. The fastening member 16 is attached from the grip side of the golf club. First of all, the inside diameter of the fastening member 16 is set to be greater than the maximum outside diameter g1 of the grip 8. Next, a rear end of the grip 8 is inserted through the fastening member 16. Then, the fastening member 16 is moved to an outside of the elastic member 10. If necessary, the inside diameter of the fastening member 16 is regulated to be greater than the outside diameter of the elastic member 10. Finally, the screw 24 is rotated so that the circumference of the fastening member 16 is shortened and the elastic member 10 is fastened by the fastening member 16. The fastening member 16 can be removed in a reverse procedure to the attachment of the fastening member 16. The circumference of the fastening member 16 can be regulated to be greater than ($g1\times\pi$). ($g1\times\pi$) indicates a circumference of a maximum outside diameter portion of the grip g1. As described above, therefore, the fastening member 16 can be freely attached to and removed from the golf club.

Thus, the fastening member 16 is constituted to enable a mutual transition of a fastening state in which the elastic member 10 is fastened and a removing state in which the fastening member 16 is removed from the elastic member 10 and is also removed from the golf club.

When the outside diameter of the elastic member 10 in an external fitting state in the shaft 6 is represented by D1, a length in the longitudinal direction of the band 20 is greater than ($D1\times\pi$). In the case in which the elastic member 10 is disposed in a position in which the outside diameter of the shaft 6 is a maximum, the outside diameter of the elastic member 10 is represented by Dm. Preferably, the length in the longitudinal direction of the band 20 is greater than ($Dm\times\pi$).

The circumference of the fastening member 16 can be regulated to be greater than the ($Dm\times\pi$). Furthermore, the circumference of the fastening member 16 can be regulated to be smaller than ($Ds\times\pi$). Ds represents an outside diameter of the elastic member 10 in the case in which the elastic member 10 is disposed in a position in which the outside diameter of the shaft 6 is minimized. Thus, the circumference of the fastening member 16 can be regulated to fasten the elastic member 10 in all positions in the longitudinal direction of the shaft 6. The circumference is measured on the internal surface of the band 20.

The elastic member 10 is provided between the shaft 6 and the fastening member 16. The fastening member 16 does not come in contact with the shaft 6 in the fastening state. Accordingly, the shaft 6 can be prevented from being damaged due to the contact of the fastening member 16.

A material of the fastening member 16 is not restricted. Examples of the material of the fastening member 16 include a metal, a resin, FRP (fiber reinforced plastic) and the like. Examples of the metal include steel, an aluminum alloy, a magnesium alloy, a titanium alloy and the like. In respect of a suppression of an increase in a weight of the golf club, a metal having a small specific gravity is preferable, and more specifically, the aluminum alloy, the magnesium alloy, the titanium alloy and the like are preferable.

A material of the elastic member 10 is not restricted. Examples of a material of a base polymer of the elastic member 10 include a vulcanized rubber, a thermosetting resin, a thermoplastic resin and the like. The thermosetting resin includes a thermosetting elastomer constituted by a hard segment and a soft segment. The thermoplastic resin includes a thermoplastic elastomer constituted by a hard segment and a soft segment. It is preferable that the base material of the elastic member 10 should be set to be a viscoelastic material. The elastic member 10 can effectively absorb a vibration in hitting.

Specific examples of the base polymer of the elastic member 10 include a natural rubber, SBR (styrene-butadiene rubber), a rubber obtained by adding carbon black to SBR, a butyl rubber, an isoprene rubber, a silicone rubber, EPDM (ethylene-propylene-diene rubber), a polyurethane resin, a nylon resin, a polyethylene-nylon copolymer and the like.

Examples of the polyetylene-nylon copolymer include trade name "PEBAX" manufactured by ATOCHEM CO., LTD. The SBR (styrene-butadiene rubber), the rubber obtained by adding carbon black to SBR, the polyurethane resin, the nylon resin and the polyethylene-nylon copolymer are easily formed and regulated in a hardness, and therefore, are preferable. Since the EPDM is easily regulated in a hardness through a content of oil, it is preferable.

It is preferable that a complex elastic modulus of the elastic member 10 should be equal to or higher than $1.4\times10^7$ (dyn/cm$^2$). By setting the complex elastic modulus to be equal to or higher than $1.4\times10^7$ (dyn/cm$^2$), it is possible to easily match a vibration of the shaft 6 with that of the elastic member 10 in hitting, resulting in an enhancement in a vibration absorbing performance. From this viewpoint, the complex elastic modulus of the elastic member 10 is more preferably equal to or higher than $1.0\times10^8$ (dyn/cm$^2$) and is further preferably equal to or higher than $3.9\times10^8$ (dyn/cm$^2$).

It is preferable that the complex elastic modulus of the elastic member 10 should be equal to or lower than $2.0\times10^{10}$ (dyn/cm$^2$). By setting the complex elastic modulus to be equal to or lower than $2.0\times10^{10}$ (dyn/cm$^2$), it is possible to match a vibration of the shaft 6 with that of the elastic member 10 in hitting, resulting in an enhancement in the vibration absorbing performance. From this viewpoint, the complex elastic modulus of the elastic member 10 is more preferably equal to or lower than $1.4\times10^{10}$ (dyn/cm$^2$) and is further preferably equal to or lower than $2.7\times10^9$ (dyn/cm$^2$).

By changing a blend of the vulcanized rubber, for example, it is possible to regulate the complex elastic modulus. For the material, PEBAX 5533 manufactured by ATOCHEM CO., LTD. has a complex elastic modulus of $2.72\times10^9$ (dyn/cm$^2$), 11-NYLON has a complex elastic modulus of $1.45\times10^{10}$ (dyn/cm$^2$), and a silicone rubber has a complex elastic modulus of $1.41\times10^7$ (dyn/cm$^2$), for example.

The complex elastic modulus is measured at a frequency of 10 Hz on a condition of 5° C. The complex elastic modulus is measured by using a viscoelastic measuring apparatus. For the viscoelastic measuring apparatus, it is possible to use a viscoelastic spectrometer DVA200 manufactured by SHIMADZU CORPORATION. A dimension of a specimen is set to have a width of 4.0 mm, a thickness of 1.6 mm, and a length in a displaced portion of 20.0 mm. A frequency is set to be 10 Hz, a temperature rising speed is set to be 2° C./min, an initial strain is set to be 2 mm, a displacing amplitude is set to be ±12.5 mm and a displacement in a pulling direction is applied to make a vibration so that the measurement is carried out. Consequently, a value at 5° C. is employed as the complex elastic modulus.

In respect of an enhancement in the vibration absorbing performance, a specific gravity of the elastic member 10 is preferably equal to or higher than 1.0, is more preferably equal to or higher than 1.2 and is further preferably equal to or higher than 1.4. In order to increase the specific gravity of the elastic member 10, it is effective to blend powder of a metal having a high specific gravity or the like. By the blend, a strength of the elastic member 10 is apt to be reduced. In respect of an increase in a strength of the elastic member 10, the specific gravity of the elastic member 10 is preferably equal to or lower than 20, is more preferably equal to or lower than 15, is further preferably equal to or lower than 10, and is particularly preferably equal to or lower than 5. By changing a blending rate of the metal powder, it is possible to regulate the specific gravity. Examples of the metal include tungsten, titanium oxide, a tungsten-nickel alloy, copper oxide and the like.

In respect of an enhancement in the vibration absorbing performance, a thickness t of the elastic member 10 is preferably equal to or greater than 1.0 mm, is more preferably equal to or greater than 1.5 mm, and is further preferably equal to or greater than 2.0 mm. In respect of an enhancement in a stretching property to easily carry out an attachment and removal, the thickness t of the elastic member 10 is preferably equal to or smaller than 4.0 mm, is more preferably equal to or smaller than 3.5 mm, and is further preferably equal to or smaller than 3.0 mm. The thickness t of the elastic member 10 is measured in a state in which an external force does not act on the elastic member 10. In other words, the thickness t of the elastic member 10 is measured in a state in which the elastic member 10 is singly put stationarily.

In a section of the finest portion of the shaft 6, an area of a portion surrounded by the external surface of the shaft 6 is represented by an area S1. Typically, the finest portion of the shaft 6 indicates an adjacent portion to the head 4. When a minimum outside diameter of the shaft 6 is represented by r1, the area S1 is equal to an area of a circle having a radius of (r1/2). On the other hand, a sectional area of a hollow portion of the elastic member 10 is represented by a sectional area S2. The sectional area S2 represents a sectional area of a portion surrounded by the inner peripheral surface 14 of the elastic member 10. An area ratio (S2/S1) is preferably equal to or higher than 0.80, is more preferably equal to or higher than 0.85 and is further preferably equal to or higher than 0.90. By setting the area ratio (S2/S1) to be equal to or higher than 0.80, it is possible to prevent the elastic member 10 from being extended excessively, thereby enhancing the vibration absorbing performance. By setting the area ratio (S2/S1) to be equal to or higher than 0.80, moreover, it is possible to easily carry out a movement and an attachment and removal. The area ratio (S2/S1) is preferably equal to or lower than 1.1, is more preferably equal to or lower than 1.05 and is further preferably equal to or lower than 1.00. By setting the area ratio (S2/S1) to be equal to or lower than 1.1, it is possible to increase the contact area of the elastic member 10 and the shaft 6, thereby enhancing the vibration absorbing effect. By setting the area ratio (S2/S1) to be equal to or lower than 1.1, moreover, it is possible to easily fix the elastic member 10. The sectional area S2 is measured in the state in which the external force does not act on the elastic member 10. In other words, the sectional area S2 is measured in the state in which the elastic member 10 is singly put stationarily.

In a typical wood type golf club, the finest portion of the shaft 6 has an outside diameter of 8.5 mm. In this case, the area S1 is 56.7 mm$^2$. In order to easily fix the shaft 6, the sectional area S2 of the elastic member 10 is preferably equal to or smaller than 56 mm$^2$, is more preferably equal to or smaller than 50 mm$^2$ and is further preferably equal to or smaller than 45 mm$^2$.

In the embodiment, the elastic member 10 is separate from the fastening member 16. The elastic member 10 may be fixed to the fastening member 16.

Figure 8:
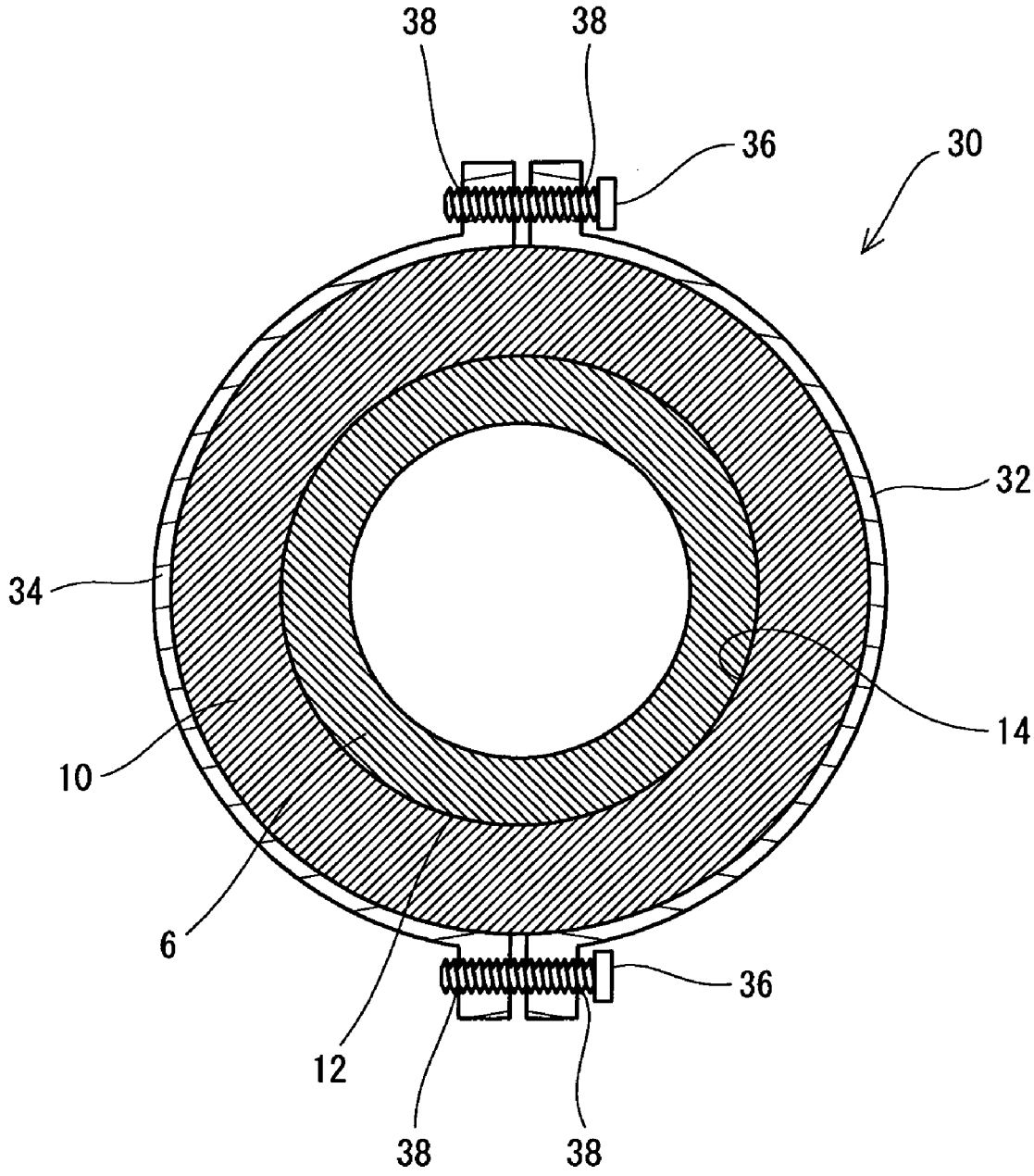
FIG. 8 is a sectional view showing a golf club to which a fastening member is attached according to a variant.

FIG. 8 is a sectional view showing a variant of the fastening member. A fastening member 30 according to an embodiment of FIG. 8 has a divided member 32, a divided member 34 and two coupling screws 36. The divided member 32 has a section taking an almost semicircular shape. The divided member 32 takes a semicylindrical shape. A screw hole 38 capable of fastening the coupling screw 36 thereinto is provided on both ends of the divided member 32. The divided member 34 takes a semicylindrical shape. A screw hole 38 capable of fastening the coupling screw 36 thereinto is provided on both ends of the divided member 34. The coupling screw 36 couples the divided bodies 32 and 34 to each other.

The fastening member 30 can be brought into an end state in which at least one place in the circumferential direction is broken. More specifically, the fastening member 30 can be brought into the end state through the removal of the coupling screw 36. The fastening member 30 can be brought into the end state in which two places in the circumferential direction are broken. The fastening member 30 set in the end state can be caused to cover the elastic member 10 from an outside in the radial direction of the elastic member 10. When the coupling screw 36 is fastened, the fastening member 30 is brought into a connecting state in the circumferential direction. In other words, the coupling screw 36 is fastened so that the fastening member 30 becomes ring-shaped and is brought into a non-end state. By the fastening, the fastening member 30 is externally fitted in the elastic member 10. It is possible to regulate the fastening degree by the coupling screw 36. Since the fastening member 30 can be caused to cover the elastic member 10 from the outside in the radial direction of the elastic member 10, it can be easily attached and removed. Thus, the fastening member 30 is constituted to enable the mutual transition of the fastening state in which the elastic member 10 is fastened and the removing state in which the fastening member 30 is removed from the elastic member 10 and is also removed from the golf club.

Figure 9:
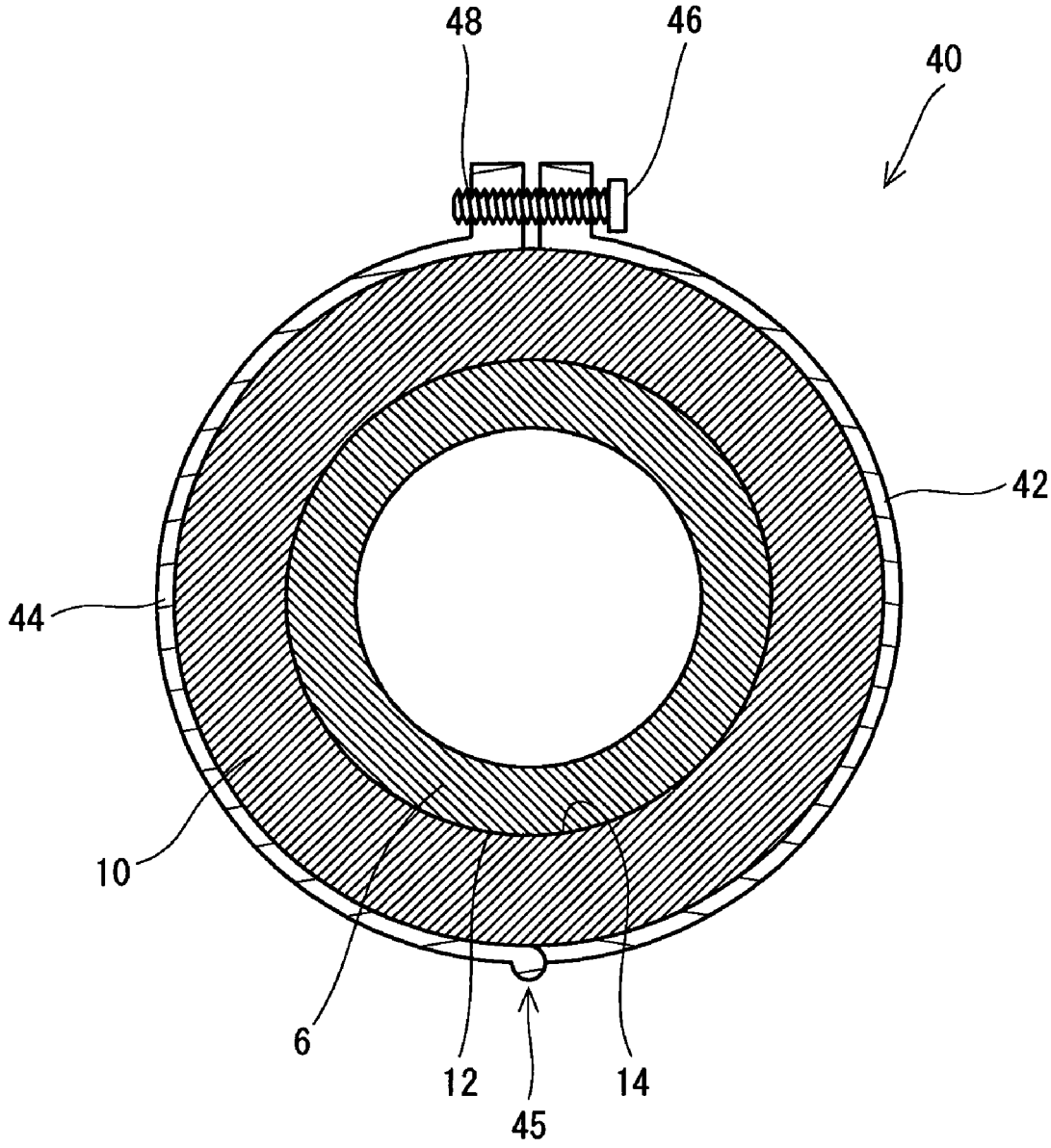
FIG. 9 is a sectional view showing a golf club to which a fastening member is attached according to another variant.

FIG. 9 is a sectional view showing another variant of the fastening member. A fastening member 40 according to the embodiment of FIG. 9 has a first member 42, a second member 44 and a coupling screw 46. The first member 42 has a section taking an almost semicircular shape. The first member 42 takes a semicylindrical shape. The second member 44 has a section taking an almost semicircular shape. The second member 44 takes a semicylindrical shape. One of ends of the first member 42 and that of the second member 44 are rotatably coupled to each other through a rotation coupling portion 45. A hinge is formed by the first member 42 and the second member 44. A screw hole 48 is provided on the other end of the first member 42 and that of the second member 44. The other end of the first member 42 and that of the second member 44 are coupled to each other through the coupling screw 46.

The fastening member 40 can be brought into an end state in which a place in a circumferential direction is broken. More specifically, the fastening member 40 can be brought into the end state by removing the coupling screw 46. By the hinge mechanism, the fastening member 40 is opened in such a manner that the first member 42 and the second member 44 are separated from each other. The fastening member 40 in the open state can be caused to cover the elastic member 10 from the outside in the radial direction of the elastic member 10. When the coupling screw 46 is fastened, the fastening member 40 is brought into a connecting state in the circumferential direction. In other words, the coupling screw 46 is fastened so that the fastening member 40 becomes ring-shaped and has no end. By the fastening, the fastening member 40 is externally fitted in the elastic member 10. It is possible to regulate the fastening degree of the coupling screw 46. Since the fastening member 40 can be caused to cover the elastic member 10 from the outside in the radial direction of the elastic member 10, it can be easily attached and removed. Thus, the fastening member 40 is constituted to enable the mutual transition of the fastening state in which the elastic member 10 is fastened and the removing state in which the fastening member 40 is removed from the elastic member 10 and is also removed from the golf club.

Figure 10:
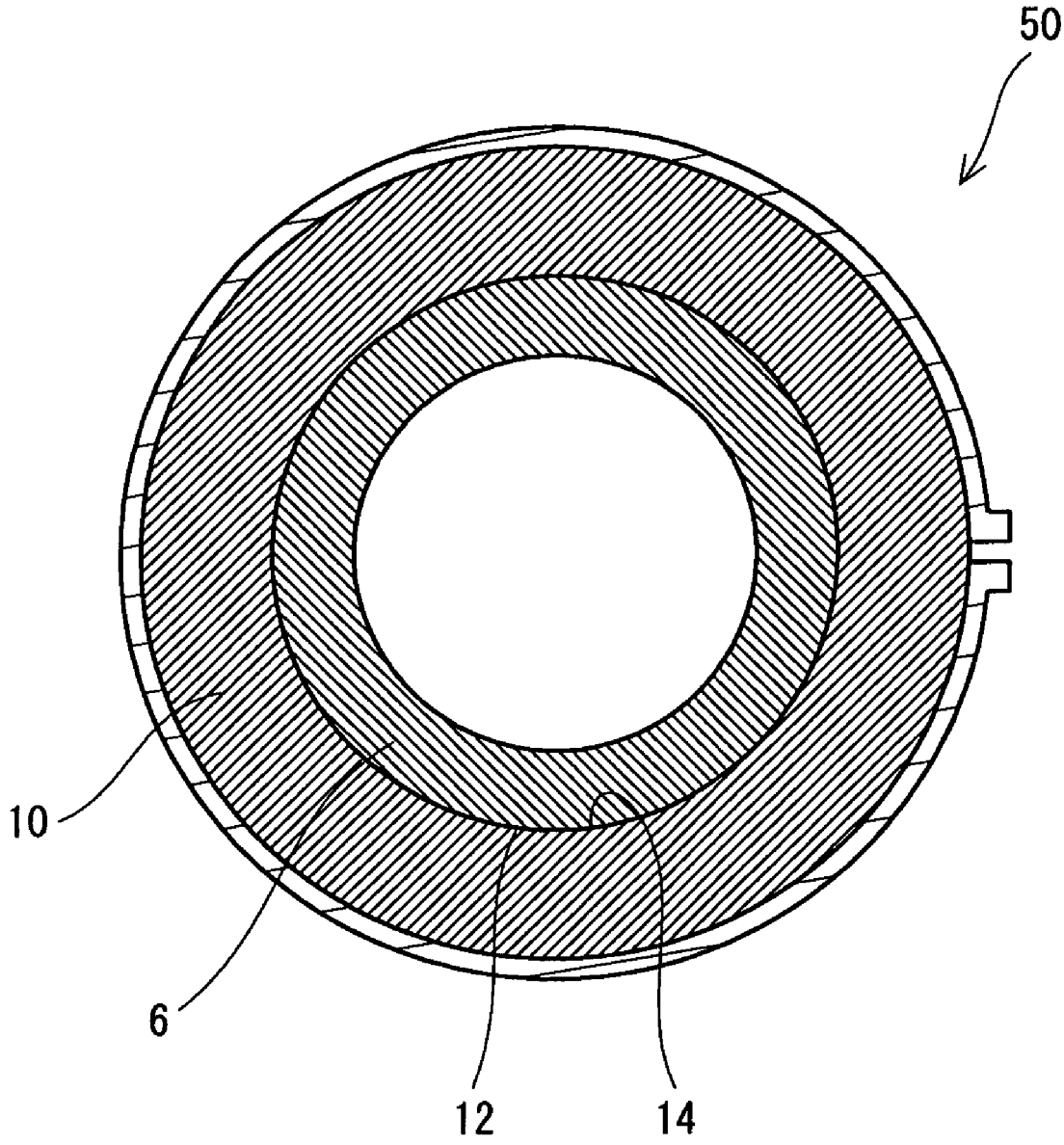
FIG. 10 is a sectional view showing a golf club to which a fastening member is attached according to a further variant.

FIG. 10 is a sectional view showing another variant of the fastening member. A fastening member 50 according to an embodiment of FIG. 10 is formed by an elastic member in which a place in the circumferential direction is broken. The fastening member 50 is formed of a metal, a resin or the like, for example. The fastening member 50 can be elastically deformed to increase a diameter. The fastening member 50 can be elastically deformed in such a manner that an inside diameter thereof is greater than the maximum outside diameter g1 of the grip 8. The fastening member 50 fastens the elastic member 10 from the outside in the radial direction by an elastic force to reduce the diameter.

When the inside diameter of the fastening member 50 set in the state in which the external force does not act is represented by Dn, the inside diameter Dn is smaller than an outside diameter D1 of the elastic member 10 set in an external fitting state in the shaft 6. Depending on a relationship, the elastic member 10 can be fastened by an elastic force of the fastening member 50. It is preferable that the inside diameter Dn should be smaller than the outside diameter Ds. Consequently, the fastening member 50 can fasten the elastic member 10 in all positions in the longitudinal direction of the shaft 6. Thus, the fastening member 50 is constituted to enable the mutual transition of the fastening state in which the elastic member 10 is fastened and the removing state in which the fastening member 50 is removed from the elastic member 10 and is also removed from the golf club.

Figure 11:
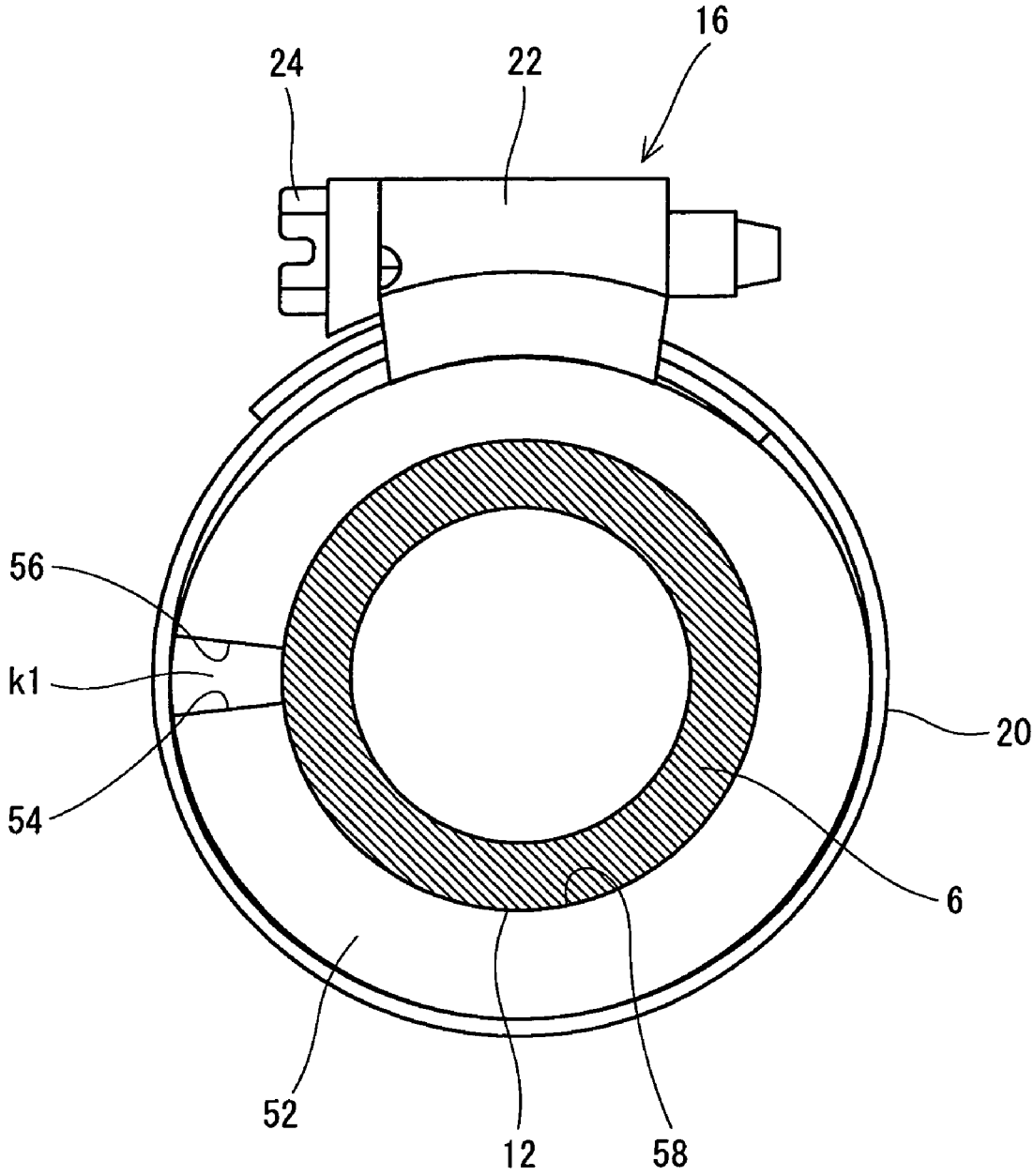
FIG. 11 is a sectional view showing a variant of the embodiment in FIG. 5.

The elastic member does not need to have no end. FIG. 11 shows a variant of the embodiment in FIG. 5. In the embodiment shown in FIG. 11, an elastic member 52 having an end is provided. The embodiment of FIG. 11 is the same as that of FIG. 5 except that the elastic member 52 has an end.

In the elastic member 52, a place in a circumferential direction is broken. The elastic member 52 has a section taking an almost C shape. The elastic member 52 has end faces 54 and 56. A space k1 is present between the end faces 54 and 56. An internal surface 58 of the elastic member 52 abuts on an external surface 12 of a shaft 6. The elastic member 52 is fastened from an outside through the fastening member 16. Since the elastic member 52 has an end, it can be deformed in such a manner that an internal surface 14 is expanded. The elastic member 52 can be attached to the shaft 6 from an outside in a radial direction of the shaft 6. The elastic member 52 is reliably fixed to the shaft 6 through the fastening member 16. In the fastening state, the fastening member 16 does not abut on the shaft 6. In a portion in which the elastic member 52 is broken, the space k1 is present between the fastening member 16 and the shaft 6. Also in the fastening state, the space k1 is maintained. In a portion in which the elastic member 52 is broken, the elastic member 52 is constituted in such a manner that the space k1 between the fastening member 16 and the shaft 6 is maintained. In order to maintain the space k1 in the fastening state, an interval between the end faces 54 and 56, a thickness of the elastic member 52, a complex elastic modulus of the elastic member 52, and the like are taken into consideration. The elastic member 52 having an end is set to have the complex elastic modulus within the preferable range so that the space k1 can easily be maintained in the fastening state, and furthermore, a high vibration absorbing performance can be exhibited.

EXAMPLES

Although the advantages of the present invention will be apparent from examples, the present invention should not be construed restrictively based on description of the examples.

Example 1

A head, a shaft and a grip were assembled to obtain a golf club. A maximum outside diameter g1 of the grip was 27 mm.

On the other hand, a ring-shaped and non-end elastic member was formed. A material of the elastic member was formed by a silicone rubber and had a complex elastic modulus of $1.41\times10^7$ dyn/cm$^2$. The elastic member had a thickness t of 3 mm, an inside diameter of 9 mm and a width of 15 mm. The elastic member was extended to insert the grip therethrough and was disposed in a predetermined position of a surface of the shaft. Next, the elastic member was fastened from an outside in a radial direction through the same fastening member as the fastening member 16. A width of a band in the fastening member was set to be 12 mm. Thus, the golf club shown in FIG. 4 was obtained. Since the width of the band is smaller than that of the elastic member, a contact of the fastening member with the shaft was prevented reliably. Hitting was carried out by using the golf club so that the elastic member was maintained to be fixed. Moreover, the fastening member and the elastic member could be attached to and removed from the golf club.

Example 2

A golf club according to an example 2 was obtained in the same manner as that in the example 1 except that a thickness t of an elastic member was set to be 2 mm, a base polymer of the elastic member was set to be SBR and a complex elastic modulus thereof was set to be $5.07\times10^7$ dyn/cm$^2$. The elastic member was formed by kneading 100 parts by weight of SBR with 1.5 parts by weight of sulfur and then carrying out heating and pressurization. Hitting was carried out by using the golf club so that the elastic member was maintained to be fixed. Moreover, the fastening member and the elastic member could be attached to and removed from the golf club.

The present invention can be applied to all golf clubs, for example, a wood type golf club, an iron type golf club, a patter and the like.

The above description is only illustrative and various changes can be made without departing from the scope of the present invention.

What is claimed is:

1. A golf club comprising a head, a shaft and a grip, wherein an elastic member is attached to an external surface of the shaft, the elastic member is ring-shaped and has no end, the elastic member is externally fitted on the shaft in a state in which an elastic contracting force is maintained, the elastic member can be elastically deformed in such a manner that an inside diameter thereof is greater than the maximum outside diameter of the grip, an area ratio (S2/S1) of a sectional area S2 of a hollow portion of the elastic member to a sectional area S1 of the finest portion of the shaft is equal to or higher than 0.80 and equal to or lower than 1.1, and the elastic member can be freely attached to and removed from an assembled club, wherein concavo-convex portions are provided on an internal surface of the elastic member.

2. The golf club according to claim 1, further comprising a fastening member for fastening the elastic member from an outside, the fastening member being constituted to enable a mutual transition of a fastening state in which the elastic member is fastened and a removing state in which the fastening member is removed from the elastic member and is also removed from the golf club, and the fastening member being provided is not in contact with the shaft in the fastening state.

3. The golf club according to claim 2, wherein the fastening member is ring-shaped in the fastening state, and a circumference of the fastening member can be regulated.

4. The golf club according to claim 3, wherein the circumference regulating mechanism is a worm mechanism.

5. A golf club comprising a head, a shaft, a grip, an elastic member and a fastening member, wherein the elastic member is attached to an external surface of the shaft, the elastic member is ring-shaped and has no end, the elastic member is externally fitted on the shaft in a state in which an elastic contracting force is maintained;

the fastening member fastens the elastic member from the outside, the fastening member is constituted to enable a mutual transition of a fastening state in which the elastic member is fastened and a removing state in which the fastening member is removed from the elastic member and is also removed from the golf club, the fastening member is not in contact with the shaft in the fastening state; and a complex elastic modulus of the elastic member is equal to or higher than $1.4\times10^7$ (dyn/cm$^2$) and is equal to or lower than $2.0\times10^{10}$ (dyn/cm$^2$), wherein the elastic member can be elastically deformed in such a manner that an inside diameter thereof is greater than the maximum outside diameter of the grip, wherein the elastic member can be freely attached to and removed from an assembled club.

* * * * *